US008858079B2

(12) United States Patent
Jiang et al.

(10) Patent No.: US 8,858,079 B2
(45) Date of Patent: Oct. 14, 2014

(54) THREE-DIMENSIONAL PLASTIC BAG AND PRODUCTION THEREOF

(75) Inventors: Tieying Jiang, Shrewsbury, MA (US); Jeffrey Carter, Hopkinton, MA (US)

(73) Assignee: GE Healthcare Bio-Sciences AB, Uppsala (SE)

( * ) Notice: Subject to any disclaimer, the term of this patent is extended or adjusted under 35 U.S.C. 154(b) by 266 days.

(21) Appl. No.: 12/636,839

(22) Filed: Dec. 14, 2009

(65) Prior Publication Data

US 2011/0142379 A1 Jun. 16, 2011

(51) Int. Cl.
*B65D 33/02* (2006.01)
*B65D 30/00* (2006.01)

(52) U.S. Cl.
CPC ..... *B65D 33/02* (2013.01)
USPC ..... 383/119

(58) Field of Classification Search
CPC ..... B65D 33/02; B65D 75/008
USPC ..... 383/119, 107, 104, 28, 906, 80, 121.1; 220/9.1–9.3; 222/92, 107, 566; 493/186
See application file for complete search history.

(56) References Cited

U.S. PATENT DOCUMENTS

| | | | | |
|---|---|---|---|---|
| 3,523,637 | A * | 8/1970 | Stec | 383/98 |
| 5,088,642 | A * | 2/1992 | Farber | 229/125.14 |
| 6,007,884 | A * | 12/1999 | Nittel | 428/35.2 |
| 7,597,244 | B2 * | 10/2009 | Boldrini et al. | 229/125.14 |
| 7,828,198 | B2 * | 11/2010 | Boldrini et al. | 229/125.015 |
| 8,074,825 | B1 * | 12/2011 | Ziegler | 220/523 |
| 2002/0130138 | A1 * | 9/2002 | Crozet et al. | 222/94 |

FOREIGN PATENT DOCUMENTS

| | | | | |
|---|---|---|---|---|
| JP | 08093702 A * | 4/1996 | | F15B 1/08 |

* cited by examiner

*Primary Examiner* — Jes F Pascua

(57) ABSTRACT

The present invention relates to an insert for reinforcement of bags made of plastic film, comprising a star-like plastic part having at least three jaws, wherein the insert is adapted for insertion and heat-sealing at a junction inside a three-dimensional bag where at least three plastic films meet, so that each jaw extends in a direction between two films. The invention also relates to a three dimensional bag incorporating such inserts and a method of producing such a bag.

3 Claims, 3 Drawing Sheets

THREE-DIMENSIONAL PLASTIC BAG AND PRODUCTION THEREOF

FIELD OF THE INVENTION

The present invention relates to an insert for reinforcement of plastic bags, an improved three-dimensional plastic bag and production thereof. The improvement comprises a plastic insert that reduces the risk of fatigue due to handling or packaging of plastic bags. The plastic bag may be used for any purpose but a preferred use is within the bioprocessing industry or hospitals where plastic bags are used as disposable containers.

BACKGROUND OF THE INVENTION

The bioprocessing industry has traditionally used stainless steel systems and piping in manufacturing processes for fermentation and cell culture. These devices are designed to be steam sterilized and reused. Cleaning and sterilization are however costly labor-intensive operations. Moreover, the installed cost of these traditional systems with the requisite piping and utilities is often prohibitive. Furthermore, these systems are typically designed for a specific process, and cannot be easily reconfigured for new applications. These limitations have led to adoption of a new approach over the last ten years—that of using plastic, single-use disposable bags and tubing, to replace the usual stainless steel tanks.

In particular bioreactors, traditionally made of stainless steel, have been replaced in many applications by disposable bags which are rocked or stirred to provide the necessary aeration and mixing necessary for cell culture. These single-use bags are typically sterile and eliminate the costly and time-consuming steps of cleaning and sterilization. The bags are designed to maintain a sterile environment during operation thereby minimizing the risk of contamination.

Bags containing sterile fluids are used in the bioprocessing industry for formulation, storage, transfer, processing, and transportation. Sterile conditions must be maintained during these operations, and the bags are usually sealed to prevent contamination. Commonly used bags are of the "pillow style," mainly because these can be manufactured at low cost by seaming together two flexible sheets of plastic. Thus, the most conventional bags are two-dimensional.

In many applications, the components contained in a bag must be mixed before use. For example, a product may be formulated from the blending of a dry powder into a fluid. In other situations, the product contained in a bag may separate during transport or storage, and require mixing before use. The mixing situation puts extra demands on the bag in relation to strength.

In the corners of conventional three-dimensional plastic bags, three films meet and are joined together, usually by heat-sealing. Every corner of a three dimensional bag has a risk of leak due to two reasons: improper seal process and fatigue of the heat-sealed area. The root cause is lack of material at the spot where three films are sealed together.

Therefore, there is a need for an improved three-dimensional plastic bag which resists fatigue (and leakage) during handling and packaging and is easy to produce.

SUMMARY OF THE INVENTION

According to the present invention a plastic part or insert is used that can fill in the gap between the films of a plastic bag to mitigate the risk of fatigue due to handling or packaging.

In a first aspect, the invention relates to an insert for reinforcement of bags made of plastic film, comprising a star-like plastic part having at least three jaws, wherein the insert is adapted for insertion and heat-sealing at a junction inside a three-dimensional bag where at least three plastic films meet, so that each jaw extends in a direction between two films.

The radius between the jaws shall preferably not be smaller than the minimum allowable bending radius of the film. The insert may be one, two or three-dimensional.

In one embodiment, the insert comprises three jaws. In this embodiment one insert is used for each three-way junction of the films of a plastic bag. Thus, in this embodiment, the plastic part looks like a star with three jaws. This part fills the gap in the unction where at least the three films meet and is heat-sealed to the respective films along its jaws.

In another embodiment, the insert comprises four jaws. In this embodiment one and the same insert is used for a four-way junction of the films of a plastic bag. This embodiment can also be seen as two integrated three jaws-inserts. This embodiment has a variable center portion to fit to any desired bag size. Thus, the insert may comprise a center portion which is variable in length to be adopted to various bag designs. Optionally, the center portion of the insert is provided with ports.

In a second aspect, the invention provides a three dimensional bag made of plastic film comprising reinforcement inserts in each junction where at least three plastic films are joined, wherein the reinforcement inserts each comprise a star-like plastic part having at least three jaws, wherein the insert is adapted for insertion and heat-sealing at a junction inside the three-dimensional bag where at least three plastic films meet, so that each jaw extends in a direction between two films. The reinforcement inserts may be part of the plastic films before they are heat-sealed together or the parts may be added to a ready made plastic bag.

The bag may comprise an adhesive material between the films in the case the films are not compatible (sealable directly to) with each other.

In a third aspect, the invention provides a method of producing a three-dimensional bag made of plastic films, comprising heat-sealing of the plastic films along their edges to form a three-dimensional bag, and re-enforcing the inner film junctions where at least three plastic films meet with a star-like plastic insert having at least three jaws, so that each jaw extends in the direction between two films.

DETAILED DESCRIPTION OF THE INVENTION

The corner of a three dimensional bag has a risk of leak due to two reasons: improper seal process and fatigue of the heat-sealed area. The root cause is lack of material and stiffness resulting in bending at a radius that is smaller than the minimum allowable bending radius of the film at the spot where the three films are sealed together.

Figure 1A:
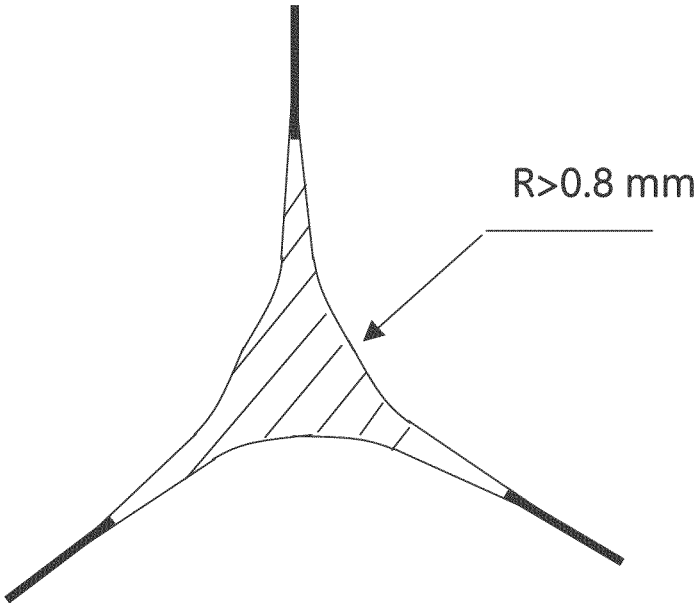
FIG. 1A is a schematic cross-sectional view of a plastic insert according to the invention having three jaws.
Figure 1B:
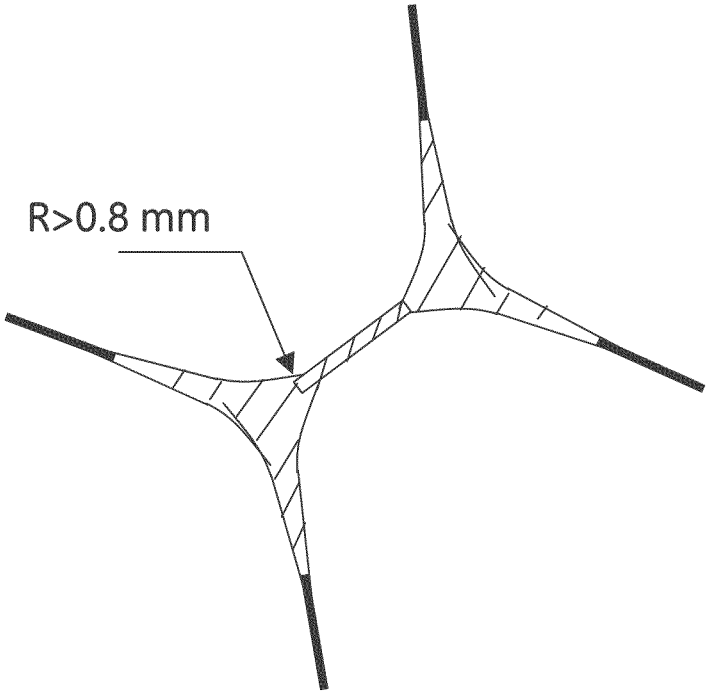
FIG. 1B is a schematic cross-sectional view of a plastic insert according to the invention having four jaws.
Figure 2A:
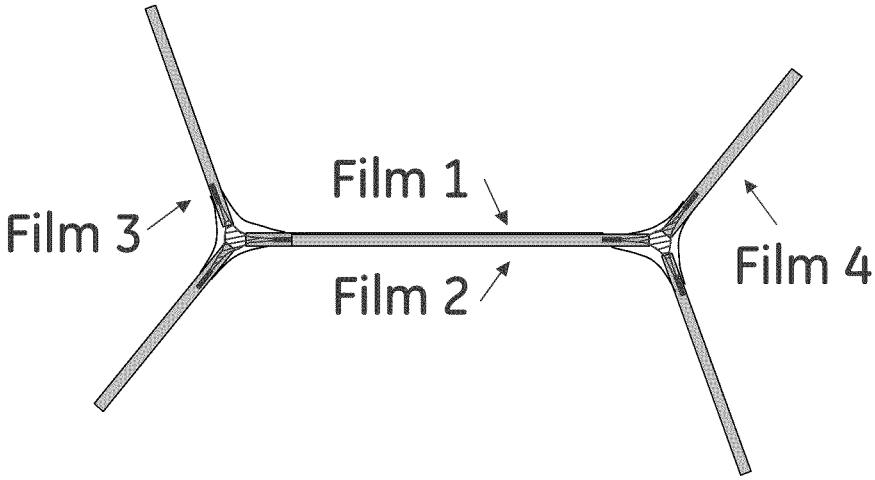
FIG. 2A is a schematic cross-sectional view of the corner of a plastic bag suitable for insertion of the plastic insert according to FIG. 1A.

According to the invention a plastic part or insert (FIG. 1A-1B) is used that can fill in the gap or reinforce the junctions between the films to mitigate the risk of fatigue due to handling or packaging of plastic bags. The plastic part/insert may have the appearance like a star with three jaws (FIG. 1A). This part fills the junction where the three films meet together and is heat-sealed to the films along its jaws (FIG. 2A).

The critical dimension of the plastic insert is the radius between the three jaws. Because the objective is to reduce the risk of fatigue due to bending, the radius shall not be smaller than the minimum allowable bending radius of the film. In the example shown in the drawings (FIG. 1A-1B), the minimal allowable bending radius is 1/32" (0.80 mm).

Figure 2B:
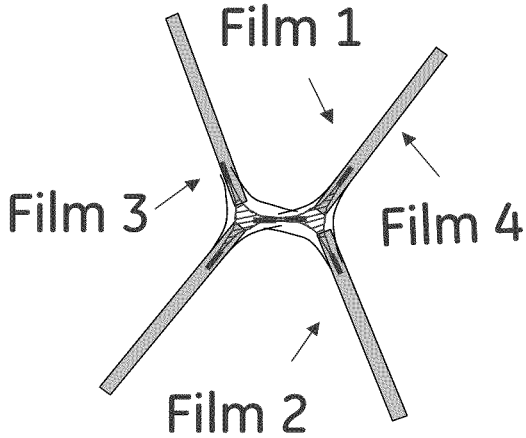
FIG. 2B is a schematic cross-sectional view of the corner of a plastic bag suitable for insertion of the plastic insert according to FIG. 1B.

The plastic insert may also be designed as a single piece with four jaws (FIG. 1B) that can be inserted into the spot where all the four films meet together (FIG. 2B). This design only requires one step of heat seal for the sealing of four films to each other.

One may also envision adding functionality to the plastic insert. For example, the molded part may include a handle that can be used to maneuver the bag into position within a drum or tank. Another possibility is the addition of one or more ports through the center of the part, making it somewhat analogous to a boat fitment with thin wings of plastic that would serve the originally described function of aiding in the three-film sealing process.

Figure 3A:
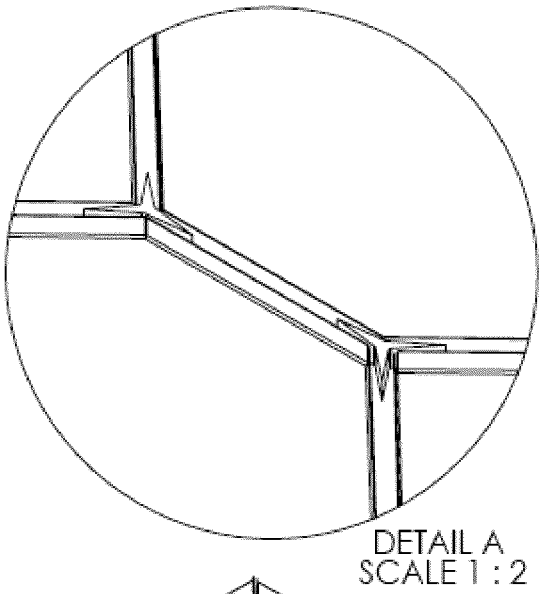
FIG. 3A is a schematic detail view of plastic inserts of the invention.
Figure 3B:
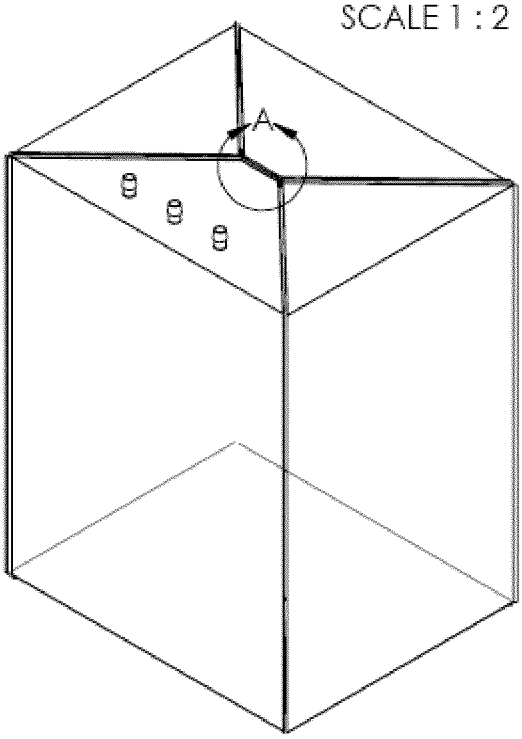
FIG. 3B is a schematic view of a three dimensional plastic bag incorporating the detail from FIG. 3A.

FIG. 3A-3B shows where the plastic inserts of the invention are positioned. FIG. 3A is an enlarged view of two three-jaws inserts, and FIG. 3B shows where these inserts are positioned in a plastic bag. The two three-jaws inserts may be replaced by one four jaws insert with an extended center portion.

In the embodiments of the invention, the inserts may be made of the same material as the plastic films. In other embodiments the inserts may be of the same material as the adhesive material on the sealing surface of laminate films. Best sealing effect is achieved when identical material are melted onto each other. Examples of plastic are polyolefins (polyethylene, polypropylene, ethylene vinyl acetate copolymers etc), PVC, perfluorinated polymers (e.g. FEP, ECTFE etc), thermoplastic elastomers and laminate where these polymers are present in a surface layer.

It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

What is claimed is:

1. A three dimensional bag made of plastic film comprising at least one reinforcement insert in each junction where at least three plastic films are joined, wherein each at least one reinforcement insert comprises a star-like plastic part having at least three jaws, wherein the insert is adapted for insertion and heat-sealing at a junction inside the three-dimensional bag where at least three plastic films meet, each at least one reinforcement insert heat-sealed to the films along its jaws, wherein the radius of each jaw is at least as great as the minimum allowable bending radius of the film sealed thereto.

2. The bag of claim 1, wherein each at least one reinforcement insert is formed from the same material as the films.

3. The bag of claim 1, further comprising an adhesive material located on the sealing surface of each of said films, the at least one reinforcement insert being formed from the adhesive material.

* * * * *